US010163620B2

(12) United States Patent
Bezel et al.

(10) Patent No.: US 10,163,620 B2
(45) Date of Patent: Dec. 25, 2018

(54) CONTINUOUS-WAVE LASER-SUSTAINED PLASMA ILLUMINATION SOURCE

(71) Applicant: KLA-Tencor Corporation, Milpitas, CA (US)

(72) Inventors: Ilya Bezel, Mountain View, CA (US); Anatoly Shchemelinin, Bozeman, MT (US); Eugene Shifrin, Sunnyvale, CA (US); Matthew Panzer, San Jose, CA (US)

(73) Assignee: KLA-Tencor Corporation, Milpitas, CA (US)

( * ) Notice: Subject to any disclaimer, the term of this patent is extended or adjusted under 35 U.S.C. 154(b) by 66 days.

(21) Appl. No.: 15/064,294

(22) Filed: Mar. 8, 2016

(65) Prior Publication Data

US 2016/0268120 A1 Sep. 15, 2016

Related U.S. Application Data

(60) Provisional application No. 62/131,645, filed on Mar. 11, 2015.

(51) Int. Cl.
*H01J 65/04* (2006.01)
*H05G 2/00* (2006.01)

(52) U.S. Cl.
CPC ..... *H01J 65/04* (2013.01); *H05G 2/008* (2013.01)

(58) Field of Classification Search
CPC ..... H01J 65/04
USPC ..... 250/493.1, 504 R
See application file for complete search history.

(56) References Cited

U.S. PATENT DOCUMENTS 7,465,946 B2 12/2008 Bowering et al.
7,705,331 B1 4/2010 Kirk et al.
7,786,455 B2 * 8/2010 Smith ..... B82Y 10/00 250/493.1
8,575,576 B2 * 11/2013 Solarz ..... G01N 21/718 250/504 R
8,796,652 B2 8/2014 Bezel et al.
8,829,478 B2 9/2014 Ershov
(Continued)

FOREIGN PATENT DOCUMENTS

WO 2015013185 A1 1/2015
WO WO 2015013185 A1 * 1/2015 ..... H05G 2/008

OTHER PUBLICATIONS

PCT Search Report for PCT/US2016/021816 dated Jun. 15, 2016, 3 pages.

(Continued)

*Primary Examiner* — Michael Maskell
(74) *Attorney, Agent, or Firm* — Suiter Swantz pc llo

(57) ABSTRACT

An optical system for generating broadband light via light-sustained plasma formation includes a chamber, an illumination source, a set of focusing optics, and a set of collection optics. The chamber is configured to contain a buffer material in a first phase and a plasma-forming material in a second phase. The illumination source generates continuous-wave pump illumination. The set of focusing optics focuses the continuous-wave pump illumination through the buffer material to an interface between the buffer material and the plasma-forming material in order to generate a plasma by excitation of at least the plasma-forming material. The set of collection optics receives broadband radiation emanated from the plasma.

45 Claims, 15 Drawing Sheets

(56) References Cited

U.S. PATENT DOCUMENTS

| | | | | |
|---|---|---|---|---|
| 8,969,841 | B2 | 3/2015 | Smith | |
| 9,048,000 | B2 | 6/2015 | Smith | |
| 9,185,786 | B2 | 11/2015 | Smith | |
| 2003/0067598 | A1 | 4/2003 | Tomie | |
| 2006/0017026 | A1* | 1/2006 | Hergenhan | H05G 2/003 250/504 R |
| 2008/0237498 | A1* | 10/2008 | MacFarlane | H05G 2/003 250/493.1 |
| 2008/0258085 | A1* | 10/2008 | Bauer | H05G 2/001 250/504 R |
| 2008/0283779 | A1* | 11/2008 | Tran | G03F 7/70908 250/504 R |
| 2010/0078578 | A1* | 4/2010 | Schuermann | G03F 7/70033 250/504 R |
| 2013/0001438 | A1* | 1/2013 | Bezel | H01J 61/20 250/492.1 |
| 2013/0106275 | A1 | 5/2013 | Chimmalgi et al. | |
| 2013/0169140 | A1 | 7/2013 | Ko et al. | |
| 2013/0181595 | A1* | 7/2013 | Bezel | F21V 9/06 313/112 |
| 2013/0267096 | A1 | 10/2013 | Hawryluk et al. | |
| 2013/0287968 | A1 | 10/2013 | Ivanov et al. | |
| 2014/0042336 | A1* | 2/2014 | Bezel | H01J 61/02 250/424 |
| 2014/0291546 | A1* | 10/2014 | Bezel | H01J 65/00 250/432 R |
| 2014/0322138 | A1 | 10/2014 | Ichikawa et al. | |
| 2015/0034838 | A1* | 2/2015 | Bezel | H01J 65/04 250/432 R |
| 2015/0049778 | A1 | 2/2015 | Shchemelinin et al. | |

OTHER PUBLICATIONS

Bjoern A.M. Hansson, et al.; "Xenon Liquid-Jet Laser Plasma Source for EUV Lithography"; Soft X-Ray and EUV Imaging Systems II; Proceedings of SPIE vol. 4506 (2001); copyright 2001 SPIE; pp. 1-8.

S. Amano, et al.; "Characterization of a Laser-Plasma Extreme-Ultraviolet Source Using a Rotating Cryogenic Xe Target"; Applied Physics B Lasers and Optics; Oct. 2010, vol. 101, Issue 1, pp. 213-219.

Partial Supplementary Search Report dated May 29, 2018 for European Patent Application No. 16762534.2.

* cited by examiner

CONTINUOUS-WAVE LASER-SUSTAINED PLASMA ILLUMINATION SOURCE

CROSS-REFERENCE TO RELATED APPLICATION

The present application claims the benefit under 35 U.S.C. § 119(e) of U.S. Provisional Application Ser. No. 62/131,645 filed Mar. 11, 2015, entitled Reducing Excimer Emission from Laser-Sustained Plasmas (LSP), naming Ilya Bezel, Anatoly Shchemelinin, Eugene Shifrin, and Matthew Panzer as inventors, which is incorporated herein by reference in the entirety.

TECHNICAL FIELD

The present disclosure generally relates to continuous-wave laser-sustained plasma illumination sources, and, more particularly, to continuous-wave laser-sustained plasma illumination sources containing solid or liquid plasma targets.

BACKGROUND

As the demand for integrated circuits having ever-small device features continues to increase, the need for improved illumination sources used for inspection of these ever-shrinking devices continues to grow. One such illumination source includes a laser-sustained plasma (LSP) source. LSP light sources are capable of producing high-power broadband light. Laser-sustained light sources operate by exciting a plasma target into a plasma state, which is capable of emitting light, using focused laser radiation. This effect is typically referred to as plasma "pumping." Laser-sustained plasma light sources typically operate by focusing laser light into a sealed lamp containing a selected working material. However, the operating temperature of the lamp limits the possible species that can be contained within the lamp. Therefore, it would be desirable to provide a system for curing defects such as those identified above.

SUMMARY

An optical system for generating broadband light via light-sustained plasma formation is disclosed, in accordance with one or more illustrative embodiments of the present disclosure. In one illustrative embodiment, the optical system includes a chamber. In another illustrative embodiment, the chamber is configured to contain a buffer material in a first phase and a plasma-forming material in a second phase. In another illustrative embodiment, the optical system includes an illumination source configured to generate continuous-wave pump illumination. In another illustrative embodiment, the optical system includes a set of focusing optics configured to focus the continuous-wave pump illumination through the buffer material to an interface between the buffer material and the plasma-forming material in order to generate a plasma by excitation of at least the plasma-forming material. In another illustrative embodiment, the optical system includes a set of collection optics configured to receive broadband radiation emanated from the plasma.

An optical system for generating broadband light via light-sustained plasma formation is disclosed, in accordance with one or more illustrative embodiments of the present disclosure. In one illustrative embodiment, the optical system includes a chamber. In another illustrative embodiment, the chamber is configured to contain a buffer gas. In another illustrative embodiment, the optical system includes an illumination source configured to generate continuous-wave pump illumination. In another illustrative embodiment, the optical system includes a plasma-forming material disposed within the chamber. In one illustrative embodiment a phase of the plasma-forming material includes at least one of a solid phase or a liquid phase. In another illustrative embodiment at least a portion of the plasma-forming material is removed from a portion of a surface of the plasma-forming material proximate to the plasma. In another illustrative embodiment, the optical system includes a set of focusing optics configured to focus the continuous-wave pump illumination onto the at least a portion of the plasma-forming material removed from the portion of the surface of the plasma-forming material to generate a plasma. In another illustrative embodiment, the optical system includes a set of collection optics configured to receive broadband radiation emanated from the plasma.

An optical system for generating broadband light via light-sustained plasma formation is disclosed, in accordance with one or more illustrative embodiments of the present disclosure. In one illustrative embodiment, the optical system includes a liquid flow assembly configured to generate a flow of a plasma-forming material in a liquid phase. In another illustrative embodiment, the optical system includes an illumination source configured to generate continuous-wave pump illumination. In another illustrative embodiment, the optical system includes a set of focusing optics configured to focus the continuous-wave pump illumination into the volume of the plasma-forming material in order to generate a plasma by excitation of the plasma-forming material. In another illustrative embodiment, the optical system includes a set of collection optics configured to receive broadband radiation emanated from the plasma.

It is to be understood that both the foregoing general description and the following detailed description are exemplary and explanatory only and are not necessarily restrictive of the present disclosure. The accompanying drawings, which are incorporated in and constitute a part of the characteristic, illustrate subject matter of the disclosure. Together, the descriptions and the drawings serve to explain the principles of the disclosure.

BRIEF DESCRIPTION OF DRAWINGS

The numerous advantages of the disclosure may be better understood by those skilled in the art by reference to the accompanying figures in which.

DETAILED DESCRIPTION

Figure 1:
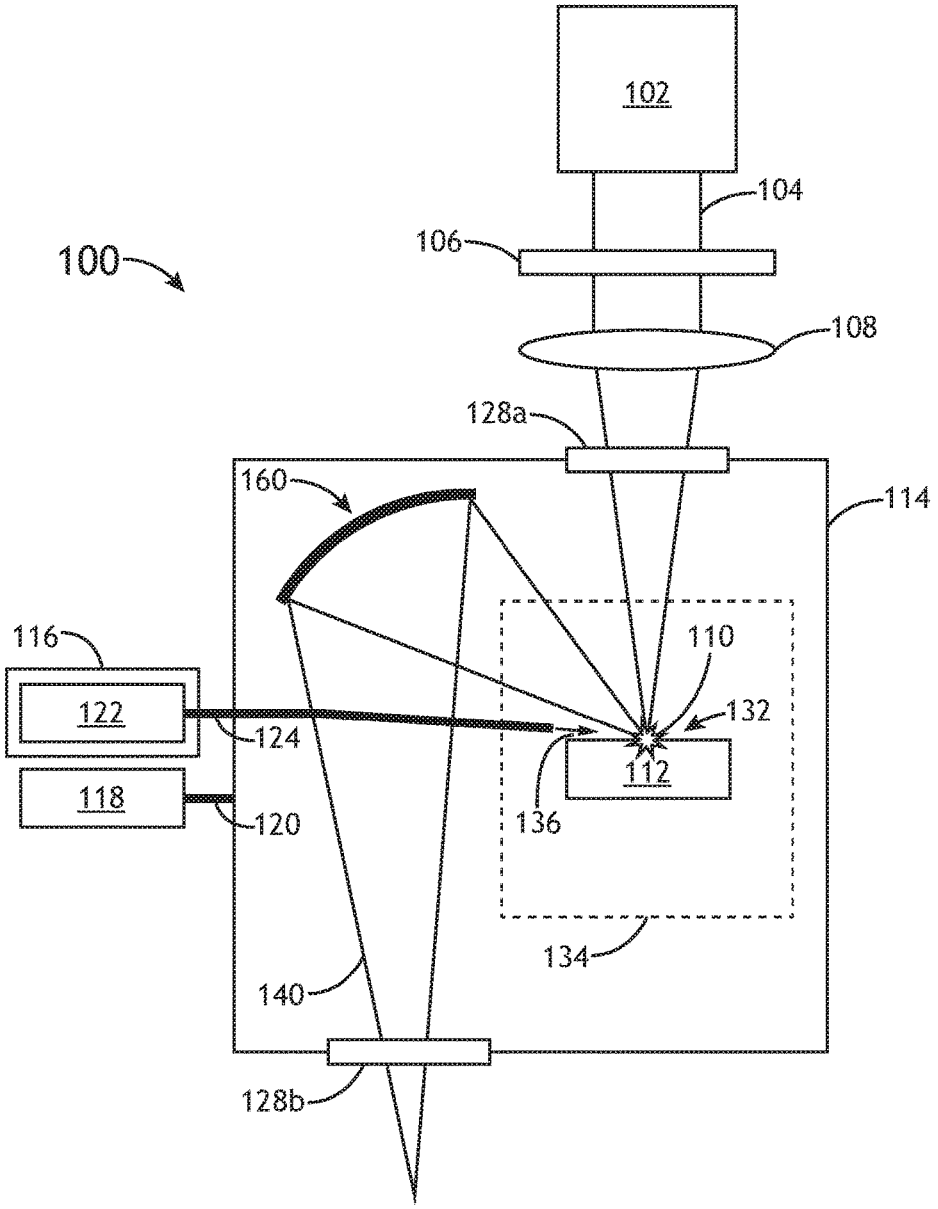
FIG. 1 is a high-level schematic view of a system for forming a continuous-wave laser-sustained plasma, in accordance with one or more embodiments of the present disclosure.

Reference will now be made in detail to the subject matter disclosed, which is illustrated in the accompanying drawings.

Referring generally to FIGS. 1 through 7C, a system for generating broadband radiation by a laser-sustained plasma using solid or liquid plasma targets is disclosed, in accordance with one or more embodiments of the present disclosure. Embodiments of the present disclosure are directed to a laser-sustained plasma source pumped by CW illumination configured to excite plasma-forming material in at least one of a solid phase or a liquid phase. Embodiments of the present disclosure are directed to the exposure of a liquid or solid plasma-forming material to CW pump illumination to generate or maintain broadband radiation output. Additional embodiments of the present disclosure are directed to a plasma-based broadband light source in which CW illumination focused proximate to a surface of a liquid or solid plasma-forming material generates or maintains a plasma. Additional embodiments of the present disclosure are directed to a plasma-based broadband light source in which CW illumination focused within a volume of a liquid plasma-forming material generates or maintains a plasma. Further embodiments of the present disclosure are directed to the generation of a plasma in a super-critical gas for the generation of broadband light output.

It is recognized herein that the plasma dynamics associated with the formation of a plasma with CW light differ substantially from plasma dynamics associated with the formation of a plasma using a pulsed laser (e.g. a Q-switched laser, a pulse-pumped laser, a mode-locked laser, or the like). For example, the absorption of energy from an illumination source by a plasma target (e.g. the penetration depth of absorbed energy, the temperature profile, and the like) is critically dependent on factors such as, but not limited to, illumination time (e.g. CW illumination time or pulse length of a pulsed laser) or peak power. As such, CW illumination may produce cooler plasmas (e.g. 1-2 eV) than pulsed illumination (e.g. 5 eV). For example, it is noted herein that plasmas generated by pulsed lasers are typically overheated for emission in an ultraviolet spectral range (e.g. 190 nm-450 nm) and exhibit correspondingly low conversion efficiency within this range. Further, CW illumination may be used to generate a plasma at nearly any pressure, including high pressures (e.g. ten or more atmospheres). In contrast, high peak power associated with pulsed lasers (e.g. pulsed lasers with pulse widths on the order of picoseconds or femtoseconds) may exhibit nonlinear propagation effects such as, but not limited to, self-focusing or ionization of a buffer material, which may negatively impact the absorption of energy by the plasma and thus limit the operating pressure. Embodiments of the present disclosure are directed to the generation of CW LSP sources emitting broadband radiation.

The generation of plasma within inert gas species is generally described in U.S. Pat. No. 7,786,455 issued on Aug. 31, 2010; U.S. Pat. No. 7,435,982, issued on Oct. 14, 2008; and U.S. patent application Ser. No. 13/647,680, filed on Oct. 9, 2012, which are incorporated herein in their entirety. The generation of plasma is also generally described in U.S. patent application Ser. No. 14/224,945, filed on Mar. 25, 2014, which is incorporated by reference herein in the entirety. Further, the generation of plasma is also generally described in U.S. patent application Ser. No. 14/231,196, filed on Mar. 31, 2014; and U.S. patent application Ser. No. 14/288,092, filed on May 27, 2014, which are each incorporated herein by reference in the entirety.

Referring to FIG. 1, in one embodiment, the system 100 includes a CW illumination source 102 (e.g., one or more lasers) configured to generate pump illumination 104 of one or more selected wavelengths, such as, but not limited to, infrared illumination or visible illumination. In another embodiment, the CW illumination source 102 is modulated by a modulation signal such that the instantaneous power of the pump illumination 104 is correspondingly modulated by the modulation signal. For example, the instantaneous power of a CW illumination source may be arbitrarily modulated within a range from no power to a maximum CW power, subject to bandwidth limitations. As an additional example, the instantaneous power of a CW illumination source may be modulated with a desired modulated waveform (e.g. a sinusoidal waveform, a square-wave waveform, a saw-tooth waveform, or the like) at a desired modulated frequency. In contrast, a pulsed laser produces pulses of radiation with minimal radiation output between pulses. Further, the pulse duration of pulses in a pulsed laser is typically on the order of microseconds to femtoseconds and is defined by gain characteristics of the laser (e.g. supported bandwidth of the gain medium, lifetime of excited states within the gain medium, or the like).

In one embodiment, the instantaneous power of a CW illumination source 102 is directly modulated (e.g. by modulating a drive current of a CW diode laser operating as a CW illumination source 102). In another embodiment, the CW illumination source 102 is modulated by a modulation assembly (not shown). In this regard, the CW illumination source 102 may provide a constant power output which is modulated by the modulation assembly. The modulation assembly may be of any type known in the art including, but not limited to, a mechanical chopper, an acousto-optic modulator, or an electro-optical modulator.

In another embodiment, the system 100 includes a chamber 114 containing a plasma target 112 formed from plasma-forming material. It is noted herein that for the purposes of the present disclosure, a plasma target 112 and plasma-forming material associated with the plasma target 112 are used interchangeably to refer to material suitable for plasma formation. In another embodiment, the chamber 114 is configured to contain, or is suitable for containing, a gas. In another embodiment, the system includes a gas management assembly 118 configured to provide a gas to the chamber via a coupling assembly 120 such that the chamber 114 contains the gas at a desired pressure.

In another embodiment, the chamber 114 includes a buffer material 132. For example, the chamber 114 may contain both buffer material 132 and plasma-forming material 112. In one embodiment, the chamber 114 includes a transmission element 128*a* transparent to one or more selected wavelengths of pump illumination 104. In another embodiment, the system 100 includes a focusing element 108 (e.g., a refractive or a reflective focusing element) configured to focus pump illumination 104 emanating from the illumination source 102 into the chamber 114 to generate a plasma 110. In one embodiment, a focusing element 108 located outside the chamber 114 focuses pump illumination through a transmission element 128*a*. In another embodiment, the system 100 includes a focusing element (not shown) located within the chamber 114 to receive and focus pump illumination 104 propagating through a transmission element 128*a* of the chamber 114. In another embodiment, the system includes a composite focusing element 108 formed from multiple optical elements.

In another embodiment, a focusing element 108 focuses pump illumination 104 from the CW illumination source 102 into the internal volume of the chamber 114 to generate or maintain a plasma 110. In another embodiment, focusing pump illumination 104 from the illumination source 102 causes energy to be absorbed by one or more selected absorption lines of plasma-forming material (e.g. from a plasma target 112), the buffer material 132 and/or the plasma 110, thereby "pumping" the plasma forming material in order to generate or maintain a plasma 110. In another embodiment, although not shown, the chamber 114 includes a set of electrodes for initiating the plasma 110 within the internal volume of the chamber 114, whereby the pump illumination 104 from the CW illumination source 102 maintains the plasma 110 after ignition by the electrodes. In another embodiment, the system includes one or more optical elements 106 to modify pump illumination 104 from the CW illumination source 102. For example, the one or more optical elements 106 may include, but are not limited to, one or more polarizers, one or more filters, one or more focusing elements, one or more mirrors, one or more homogenizers, or one or more beam-steering elements.

In another embodiment, broadband radiation 140 is generated by the plasma 110 through de-excitation of the excited species within the plasma 110 including, but not limited to, plasma-forming material or buffer material 132. Further, the spectrum of the broadband radiation 140 emitted by the plasma 110 is critically dependent on multiple factors associated with plasma dynamics including, but not limited to, the composition of species within the plasma 110, energy levels of excited states of species within the plasma 110, the temperature of the plasma 110, or the pressure surrounding the plasma 110. In this regard, the spectrum of broadband radiation 140 generated by a LSP source may be tuned to include emission within a desired wavelength range by selecting the composition of the plasma target 112 to have one or more emission lines within the desired wavelength range. Often, a desired material (e.g. a desired element, a desired species, or the like) suitable for generating emission within a desired wavelength range exists in a liquid or a solid phase such that high temperatures are required to evaporate the material and maintain a desired pressure for LSP operation. In one embodiment, the system 100 includes a solid-phase or a liquid-phase plasma target 112 in which a localized portion of the plasma target 112 is heated to remove plasma-forming material from the plasma target 112 to generate or maintain a plasma 110. In another embodiment, the power, wavelength, and focal characteristics of the CW illumination source 102 are adjusted to obtain a desired conversion efficiency of absorbed energy to emission output within a desired wavelength range. In a general sense, the system 100 can utilize any target geometry for solid or liquid plasma targets 112 known in the art. For example, the generation of a plasma on a solid target using a pulsed laser is generally described in: Amano, et al., Appl. Phys. B, Vol. 101. Issue 1, pp. 213-219, which is incorporated by reference herein in its entirety.

The plasma target 112 may include any element suitable for the formation of a plasma. In one embodiment, the plasma target 112 is formed from a metal. For example, the plasma target 112 may include, but is not limited to, nickel, copper, tin, or beryllium. In one embodiment, the plasma target 112 is in the solid phase. For example, the plasma target 112 may be formed from, but is not limited to, a crystalline solid, a polycrystalline solid, or an amorphous solid. Further, the plasma target 112 may include, but is not limited to, xenon or argon, maintained in a solid phase at a temperature below a freezing point of the plasma target 112 (e.g. by liquid nitrogen). In another embodiment, the plasma target is in a liquid phase. For example, the plasma target 112 may include a salt of a desired element dissolved in a solvent. Additionally, the plasma target 112 may include a liquid compound. In one embodiment, the plasma target 112 is a nickel carbonyl liquid. In a further embodiment, the plasma target 112 is formed from a super-critical gas. For example, the plasma target 112 may be formed from a material with a temperature and pressure higher than a critical point such that a distinct liquid phase and a distinct gas phase do not exist (e.g. a super-critical fluid).

In another embodiment, the system 100 includes a collector element 160 to collect broadband radiation 140 emitted by plasma 110. In another embodiment, a collector element 160 directs broadband radiation 140 emitted by the plasma 110 out of the chamber 114 through a transmission element 128*b* transparent to one or more wavelengths of the broadband radiation 140. In another embodiment, the chamber 114 includes one or more transmission elements 128*a*, 128*b* transparent to both pump illumination 104 and broadband radiation 140 emitted by the plasma 110. In this regard, both pump illumination 104 for generating or maintaining a plasma 110 and broadband radiation 140 emitted by the plasma 110 may propagate through the transmission element. In another embodiment, the system 100 includes a flow assembly 116 to direct a flow of buffer material 136 from a buffer material source 122 towards the plasma 110. In another embodiment, the flow assembly 116 directs the flow of buffer material 136 through a nozzle 124. In one embodiment, the flow assembly 116 directs a flow of buffer material 136 to carry plasma-forming material removed from the plasma target 112 away from components within the system 100 susceptible to damage including, but not limited to the collector element 160 or transmission element 128*a*,128*b*.

In another embodiment, the system 100 includes a target assembly 134 suitable for containing, manipulating, or otherwise positioning a plasma-forming material 112 to generate or maintain a plasma 110. It is noted herein that the plasma-forming material 112 may be in the form of a solid, a liquid, or a super-critical gas. Accordingly, the target assembly 134 includes structural elements suitable for containing, manipulating, or otherwise positioning a liquid or solid plasma forming-material 112.

Figure 2A:
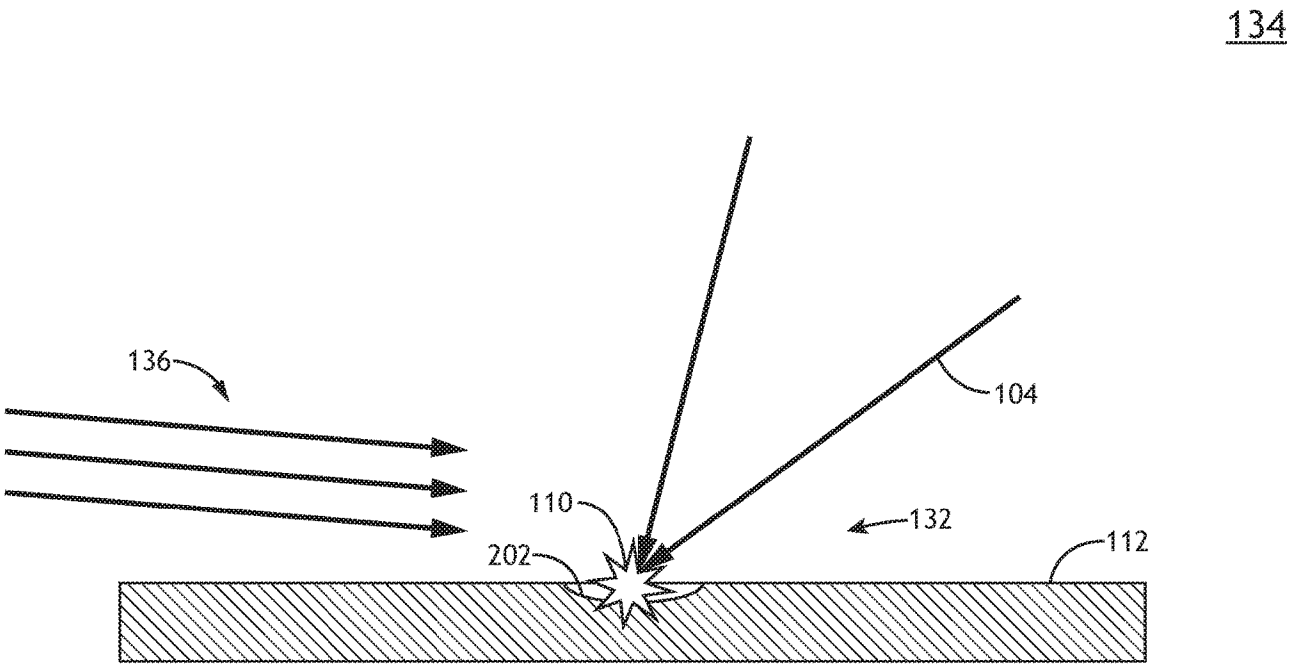
FIG. 2A is a conceptual view of a light-sustained plasma generated or maintained at the interface of a plasma target and a buffer material, in accordance with one or more embodiments of the present disclosure.
Figure 2B:
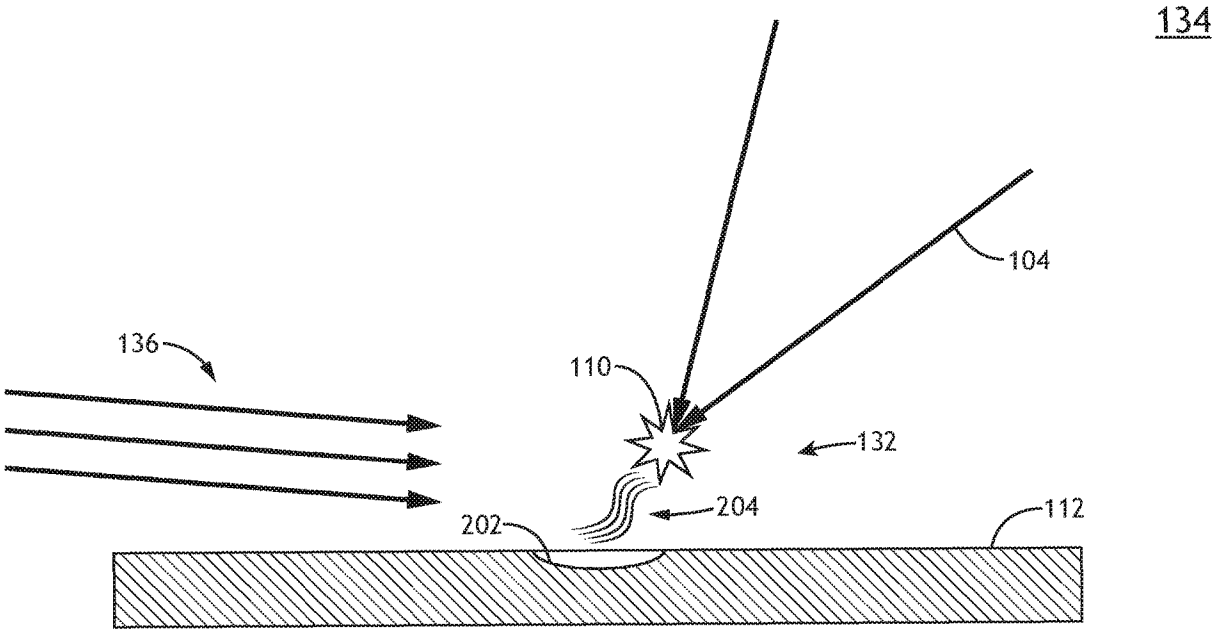
FIG. 2B is a conceptual view of a light-sustained plasma generated or maintained at a location proximate to the interface of a plasma target and a buffer material, in accordance with one or more embodiments of the present disclosure.
Figure 2C:
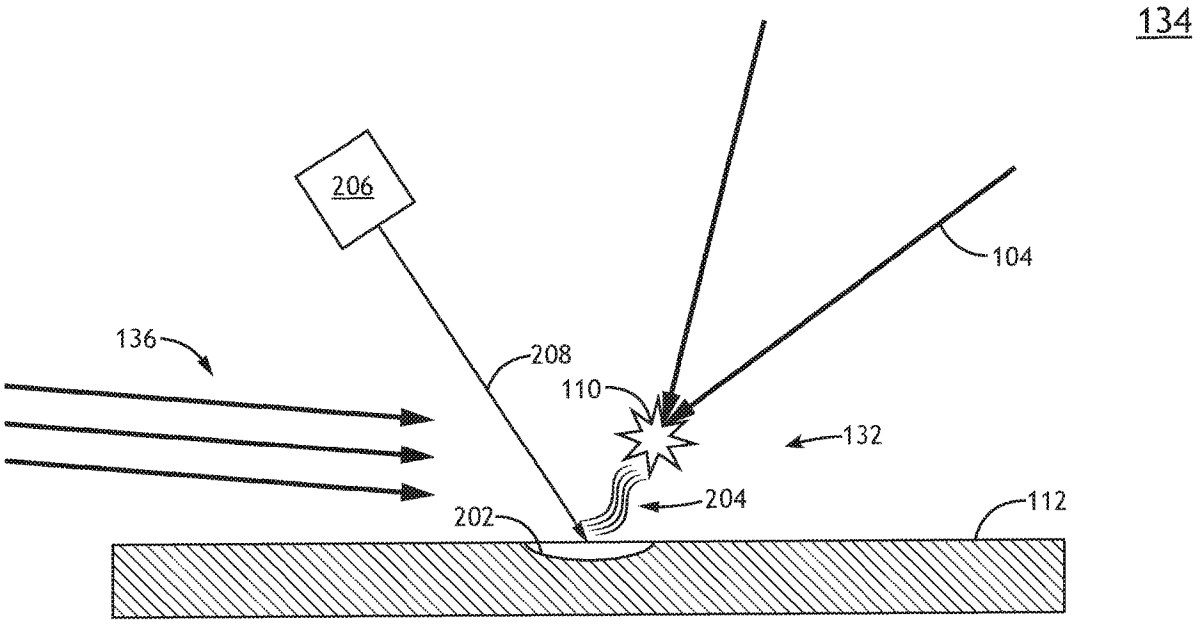
FIG. 2C is a conceptual view of a light-sustained plasma generated or maintained at a location proximate to the interface of a plasma target and a buffer material in which plasma-forming material is removed from the plasma target by an external source, in accordance with one or more embodiments of the present disclosure.

FIGS. 2A through 2C are simplified schematic views of a plasma 110 generated or maintained using a liquid or solid plasma target 112, in accordance with one or more embodiments of the present disclosure. FIG. 2A is a conceptual view of a plasma generated or maintained at the interface of a plasma target, in accordance with one or more embodiments of the present disclosure. In one embodiment, pump illumination 104 is focused (e.g. by a focusing element 108) to a surface of the plasma target 112 to generate or maintain a plasma 110. In this regard, the plasma 110 contains one or more species of plasma-forming material from the plasma target 112.

In another embodiment, a buffer material 132 is proximate to the plasma target 112. For example, a gas-phase buffer material 132 may be proximate to a solid-phase or a liquid-phase plasma target 112. As another example, a liquid-phase buffer material 132 may be proximate to a solid-phase plasma target 112. In another embodiment, a composition and/or pressure of the buffer material 132 are adjustable. For example, the composition and/or the pressure of the buffer material 132 may be adjusted to control plasma dynamics within the plasma 110. For example, the plasma dynamics may include, but are not limited to, the rate at which plasma-forming material is removed from the plasma target 112, ambient pressure in the vicinity of the plasma 110, vapor pressure surrounding the plasma 110, or the composition of the plasma 110. In this regard, a plasma 110 formed at the interface between a plasma target 112 and a buffer material 132 may be formed from plasma-forming material released from the plasma target 112 and the buffer material 132, with the relative concentration of species being controllable by the composition and pressure of the buffer material 132.

It is noted herein that a plasma 110 containing a buffer material 132 will typically exhibit broadband radiation 140 with wavelengths associated with de-excitation of species within the buffer material 132. In one embodiment, broadband radiation 140 includes one or more wavelengths emitted by the plasma-forming material and one or more wavelengths emitted by the buffer material 132. In one embodiment, broadband radiation 140 emitted by a buffer material 132 includes one or more wavelengths that do not overlap with broadband radiation 140 emitted by the plasma-forming material. In another embodiment, broadband radiation 140 emitted by a buffer material 132 includes one or more wavelengths that overlap with broadband radiation 140 emitted by the plasma-forming material. In this regard, the spectrum of broadband radiation within a desired spectral region is generated by both the plasma-forming material and the buffer material 132.

It is noted herein that a buffer material 132 may include any element typically used for the generation of laser-sustained plasmas. For example, the buffer material 132 may include a noble gas or an inert gas (e.g., noble gas or non-noble gas) such as, but not limited to hydrogen, helium, or argon. As another example, the buffer material 132 may include a non-inert gas (e.g., mercury). In another embodiment, the buffer material 132 may include a mixture of a noble gas and one or more trace materials (e.g., metal halides, transition metals and the like). For example, gases suitable for implementation in the present disclosure may include, but are not limited, to Xe, Ar, Ne, Kr, He, $N_2$, $H_2O$, $O_2$, $H_2$, $D_2$, $F_2$, $CH_4$, metal halides, halogens, Hg, Cd, Zn, Sn, Ga, Fe, Li, Na, K, Tl, In, Dy, Ho, Tm, ArXe, ArHg, ArKr, ArRn, KrHg, XeHg, and the like. In another material, the buffer material 132 may include one or more elements in a liquid phase.

In another embodiment, absorption of CW pump illumination 104 by the plasma target 112 causes the removal of plasma-forming material from the plasma target to generate or maintain a plasma 110. In this regard, plasma-forming material removed from the plasma target 112 is excited by the pump illumination 104 and emits broadband radiation 140 upon de-excitation. Plasma-forming material may be removed from the plasma target in response to absorbed pump illumination 104 by any mechanism including, but not limited to, evaporation, phase explosion, sublimation, or ablation. In one embodiment, the temperature of a heated portion 202 of a liquid-phase plasma target 112 increases in response to absorbed pump illumination, resulting in evaporation of plasma-forming material from the plasma target 112. In another embodiment, a heated portion 202 of a solid-phase plasma target 112 melts in response to absorbed pump illumination 104, resulting in the evaporation of plasma-forming material. In another embodiment, plasma-forming material sublimes from a solid-phase plasma target 112 in response to absorbed pump illumination. In a further embodiment, absorption of pump illumination 104 results in ablation and/or phase explosion of a heated portion 202 of a solid-phase plasma target 112.

In another embodiment, a flow assembly 116 directs a flow of buffer material 136 towards the plasma 110. In one embodiment, the flow of buffer material 132 replenishes the concentration of species within the buffer material 132 to maintain the plasma 110. In another embodiment, the flow of buffer material 136 directs plasma-forming material away from a path of the pump illumination 104. In this regard, the refractive index of the length of the path of the pump illumination 104 may be consistently maintained, which, in turn, facilitates stable emission of broadband radiation 140 from the plasma 110. In another embodiment, the flow of buffer material 136 directs plasma-forming material away from optical elements within the system including, but not limited to, the collector element 160 or transmission elements 128*a*,128*b*. In one embodiment, a flow assembly 116 directs a flow of buffer material 136 in a gas phase to direct evaporated plasma-forming material from a plasma target 112. In another embodiment, a flow assembly 116 directs a flow of buffer material 136 in a liquid phase towards a plasma 110.

The flow assembly 116 may be of any type known in the art suitable for directing a flow of liquid-phase or gas-phase buffer material 132. In one embodiment, a flow assembly 116 includes a nozzle 124 to direct a flow of buffer material 136 to the plasma 110. In another embodiment, a flow assembly 116 includes a circulator (not shown) to circulate buffer material 132 in a region surrounding the plasma 110. For example, a flow assembly 116 may include a liquid circulation assembly to direct a flow of liquid over the surface of a solid-phase plasma target 112.

In another embodiment, the system 100 includes a temperature-control assembly (not shown) configured to maintain the plasma target 112 at a desired temperature. In one embodiment, the temperature-control assembly removes heat from the plasma target 112 associated with absorption of energy from any heat source including, but not limited to, the pump illumination 104 or the broadband radiation 140 emitted by the plasma 110. In one embodiment, the temperature-control assembly is a heat exchanger. In another embodiment, the temperature-control assembly maintains the temperature of the plasma target 112 by directing cooled air across one or more surfaces of the plasma target 112. In another embodiment, the temperature-control assembly maintains the temperature of the plasma target 112 by directing cooled liquid across one or more surfaces of the plasma target 112. In one embodiment, the temperature-control assembly directs cooled liquid through one or more reservoirs within a solid-phase plasma target 112. In another embodiment, the temperature-control assembly maintains the temperature of a liquid-phase plasma target 112 by circulating the plasma target 112 in at least a location proximate to the plasma 110.

FIG. 2B is a conceptual view of a plasma 110 generated or maintained near a surface of a plasma target 112, in accordance with one or more embodiments of the present disclosure. In one embodiment, pump illumination 104 is focused (e.g. by a focusing element 108) to a location near the surface of the plasma target 112 to generate or maintain a plasma 110. In another embodiment, a plasma 110 containing plasma-forming material from the plasma target 112 is first generated at a location near the surface of the plasma target 112 (e.g., within the volume of a buffer material 132). Further, a heated portion 202 of the plasma target 112 is heated to remove plasma-forming material from the plasma target 112 such that the plasma-forming material propagates 204 to the plasma 110. Upon propagation to the plasma 110, the plasma-forming material absorbs pump illumination 104, is excited by absorption of CW pump illumination 104, and emits broadband radiation 140 upon de-excitation. In another embodiment, a flow assembly 116 directs a flow of buffer material 132 to direct plasma-forming material to the plasma 110.

It is noted herein that separating the generation of a plasma 110 from the removal of plasma-forming material from the plasma target 112 may provide a mechanism for controlling the concentration of species of the plasma-forming material in the plasma 110. In this regard, conditions necessary to generate or maintain a plasma 110 with a desired output of broadband radiation 140 (e.g. power and focused spot size of pump illumination 104, and the like) may be independently adjusted relative to conditions necessary to achieve the desired rate of removal of plasma-forming material from a plasma target 112 (e.g. size and temperature of the heated portion 202 of the plasma target 112, separation between the plasma 110 and the plasma target 112, and the like). Further, separating the generation of a plasma 110 from the removal of plasma-forming material from the plasma target 112 may provide for higher concentrations of plasma-forming material in the plasma 110 than provided by generating or maintaining the plasma 110 at an interface (e.g. a surface) of the plasma target 112.

Various mechanisms may contribute to heating of the heated portion 202 of the plasma target 112 to remove plasma-forming material such as, but not limited to, absorption of broadband radiation 140 emitted by the plasma, absorption of pump illumination 104, or absorption of energy from an external source. In one embodiment, the temperature of the heated portion 202 of the plasma target 112 is precisely adjusted to control the vapor pressure in a region between the plasma target 112 and the plasma 110. For example, a solid-phase nickel plasma target 112 in the presence of a gas-phase buffer material (e.g. $Ar_2$ or $N_2$) may be heated to a temperature greater than 1726 K to melt the plasma target 112, and may be further heated to a temperature of approximately 3000 K to generate a vapor pressure of 10 atm. It is noted herein that the vapor pressure in a region between the plasma target 112 and the plasma 110 may be adjusted to any desired value such as, but not limited to, values ranging from less than 1 atmosphere of pressure to tens of atmospheres of pressure.

FIG. 2C is a conceptual view of a plasma 110 generated or maintained near a surface of a plasma target 112 in which a heated portion 202 of the plasma target 112 is heated by a heating source 206 through a directed energy beam 208, in accordance with one or more embodiments of the present disclosure. In one embodiment, a heating source 206 heats a heated portion 202 of the plasma target 112 near the plasma 110 to provide a desired concentration of plasma-forming material from the plasma target 112. Plasma-forming material may be removed from the plasma target 112 in response to absorbed pump illumination 104 by any mechanism including, but not limited to, evaporation, phase explosion, sublimation, or ablation. In another embodiment, a flow assembly 116 directs a flow of buffer material 132 to direct plasma-forming material from the plasma target 112 to the plasma 110.

In another embodiment, a plasma 110 is ignited in the plasma-forming material that is removed from the plasma target 112 by the heating source 206. For example, pump illumination 104 may be focused (e.g. by a focusing element 108) to plasma-forming material in a gas phase to generate or maintain a plasma 110. In another embodiment, a plasma 110 is generated in a buffer material 132. Further, plasma-forming material removed from the plasma target 112 by the heating source 206 propagates to the plasma 110 and is subsequently excited by the pump illumination 104 such that broadband radiation 140 emitted by the plasma 110 includes one or more wavelengths of radiation associated with de-excitation of the excited plasma-forming material. In a further embodiment, the temperature of the heated portion 202 of the plasma target 112 as well as the rate of removal of plasma-forming material reach an equilibrium based on energy absorbed by energy sources including, but not limited to, the heating source 206, broadband radiation 140 emitted by the plasma 110, or pump illumination 104 incident on the plasma target 112.

The heating source 206 may be of any type known in the art suitable for removing plasma-forming material from the plasma target 112 for excitation by the CW pump illumination 104 including, but not limited to, an electron beam source, an ion beam source, an electrode configured to generate an electric arc between the electrode and the plasma target 112, or an illumination source (e.g. one or more laser sources). In one embodiment, the heating source 206 is a laser source configured to focus a beam of radiation onto the plasma target 112. In another embodiment, the CW illumination source 102 is configured as the heating source 206. For example, a portion of the pump illumination 104 generated by the CW illumination source 102 may be separated (e.g. by a beamsplitter) to form the directed energy beam 208. Further, the power and focal characteristics of the directed energy beam 208 generated by the CW illumination source 102 may be adjusted independent of the pump illumination 104 focused into the chamber 114 to generate or maintain the plasma 110.

In another embodiment, the heating source 206 is an electric arc generator configured to generate an electric arc 208 between an electrode and the plasma target 112. In this regard, a voltage may be generated between an electrically conductive plasma target 112 and an electrode such that an electric arc is generated in the buffer material 132 to heat the plasma target 112.

In a further embodiment, the heating source 206 is a particle source configured to generate an energetic beam of particles such as, but not limited to, electrons or ions. Further, the chamber 114 may include sources of electric fields (e.g. electrodes) and magnetic fields (e.g. electromagnets or permanent magnets) to direct the beam of particles to the plasma target 112.

In another embodiment, the target assembly 134 includes a mechanism to translate the plasma target 112 such that plasma-forming material removed from the plasma target 112 is replenished. For example, the target assembly 134 may translate the plasma target 112 via at least one of rotation or linear motion.

Figure 3A:
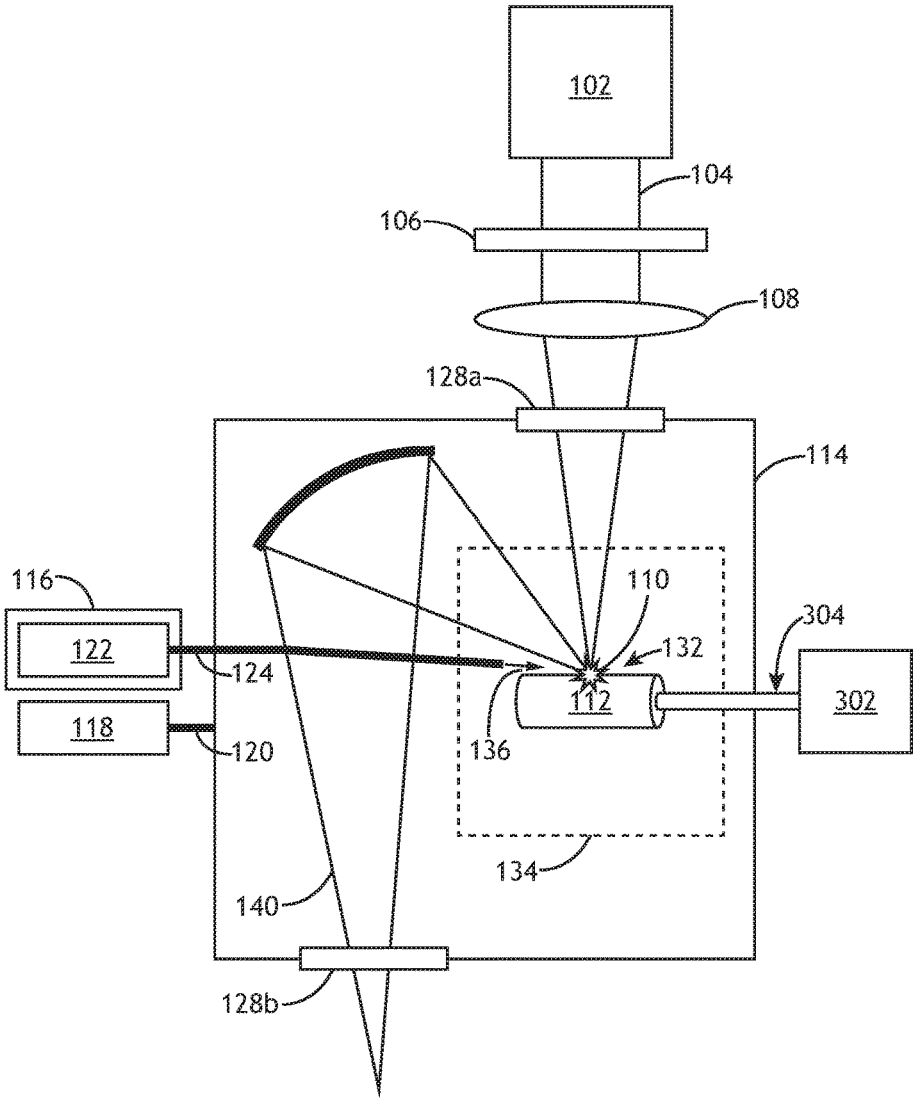
FIG. 3A is a high-level schematic view of a system for forming a continuous-wave laser-sustained plasma at the surface of a solid plasma target in the presence of a gas buffer material, in accordance with one or more embodiments of the present disclosure.
Figure 3B:
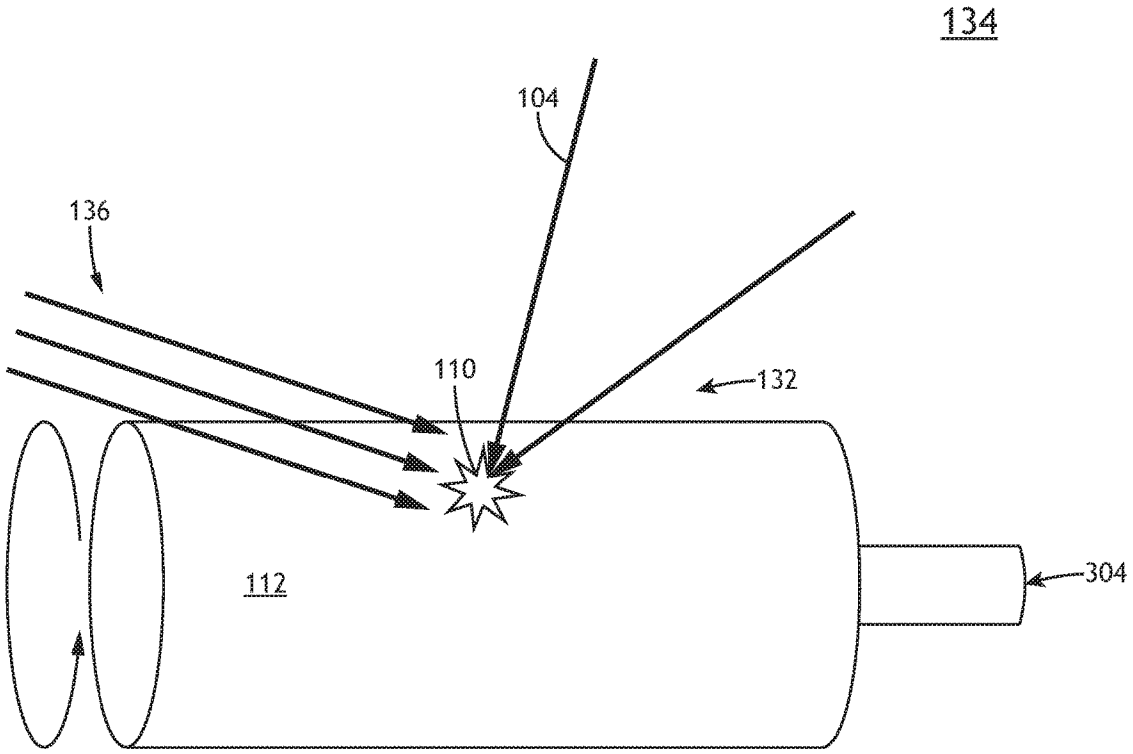
FIG. 3B is a high-level schematic view of a rotatable plasma target, in accordance with one or more embodiments of the present disclosure.

FIG. 3A is a simplified schematic view of a system 100 for generating broadband radiation 140 emitted by a plasma 110 generated with a solid-phase plasma target 112 in the presence of a gas-phase buffer material 132, in accordance with one or more embodiments of the present disclosure. The generation of a plasma on a sold target using a pulsed laser is generally described in: Amano, et al., Appl. Phys. B, Vol. 101. Issue 1, pp. 213-219, which is incorporated by reference herein in its entirety. In one embodiment, the system 100 includes a rotatable plasma target 112. In another embodiment, the rotatable plasma target 112 is cylindrically symmetric about a rotation axis. FIG. 3B is a high-level schematic view of a target assembly with a rotatable, cylindrically symmetric plasma target 112, in accordance with one or more embodiments of the present disclosure. It is noted herein that a plasma 110 may be generated at the interface of a plasma target 112 and a buffer material 132 (e.g. as shown in FIG. 2A) or at a distance from a surface of the plasma target 112 (e.g. as shown in FIGS. 2B and 2C).

In another embodiment, the system 100 includes at least one actuation device 302. In one embodiment, the actuation device 302 is configured to actuate the plasma target 112. In one embodiment, the actuation device 302 is configured to control the axial position of the plasma target 112. For example, the actuation device 302 may include a linear actuator (e.g., linear translation stage) configured to translate the plasma target 112 along an axial direction along the rotation axis. In another embodiment, the actuation device 302 is configured to control the rotational state of the plasma target 112. For example, the actuation device 302 may include a rotational actuator (e.g., rotational stage) configured to rotate the plasma target 112 along rotational direction such that the plasma 110 traverses along the surface of the plasma target 112 at a selected axial position at a selected rotational speed. In another embodiment, the actuation device 302 is configured to control the tilt of the plasma target 112. For example, a titling mechanism of the actuation device 302 may be used to adjust the tilt of the plasma target 112 in order to adjust a separation distance between the plasma 110 and the surface of the plasma target 112.

In another embodiment, the plasma target 112 may be coupled to the actuation device 302 via a shaft 304. It is recognized herein that the present invention is not limited to the actuation device 302, as described previously herein. As such, the description provided above should be interpreted merely as illustrative. For instance, the CW illumination source 102 may be disposed on an actuating stage (not shown), which provides translation of the pump illumination 104 relative to the plasma target 112. In another instance, the pump illumination 104 may be controlled by various optical elements to cause the beam to traverse surface of the plasma target 112 as desired. It is further recognized that any combination of plasma target 112, illumination source 102 and mechanisms to control the pump illumination 104 may be used to traverse the pump illumination 104 across the plasma target 112 as required by the present invention.

In one embodiment, the rotatable plasma target 112 includes a cylinder, as shown in FIGS. 3A and 3B. In other embodiments, the rotatable plasma target 112 includes any cylindrically symmetric shape in the art. For example, the rotatable plasma target 112 may include, but is not limited to, a cylinder, a cone, a sphere, an ellipsoid or the like. Further, the rotatable plasma target 112 may include a composite shape consisting of two or more shapes.

In another embodiment, the rotatable plasma target 112 is formed from a solid phase of plasma-forming material. In one embodiment, the plasma target 112 is a solid cylinder of plasma-forming material. In another embodiment, the rotatable plasma target 112 is at least partially coated with a plasma-forming material. For example, the rotatable plasma target 112 may be coated with a film of a plasma-forming material (e.g. a nickel film). As another example, the plasma-forming material may include, but is not limited to, xenon or argon, maintained at a temperature below a freezing point. In another embodiment, the plasma-forming material may include a solid material disposed on the surface of the rotatable plasma target 112. For example, the plasma-forming material may include, but is not limited to, xenon or argon, frozen onto the surface of the rotatable plasma target.

In another embodiment, the system includes a material supply assembly (not shown) to supply plasma-forming material to a surface of the plasma target 112 within the chamber 114. For example, the material supply assembly may supply a plasma-forming material to the surface of the plasma target 112 via a nozzle. In one embodiment, the material supply assembly may direct a gas, liquid stream or spray onto the surface of the plasma target 112 as it rotates, and is maintained at a temperature below the freezing point of the selected plasma-forming material. In another embodiment, the material supply assembly may also serve to 'recoat' one or more portions of the plasma target 112 following removal of plasma-forming material from the heated portion 202 of the plasma target 112. In another embodiment, the material supply assembly includes a plasma-forming material recycling subsystem to recover the plasma-forming material from the chamber 114 and resupplies it to material supply assembly.

In another embodiment, the system 100 may include a mechanism (not shown) to improve the quality of a layer of plasma-forming material on the plasma target 112. In one embodiment, the system 100 may include a thermal device and/or a mechanical device located outside of the plasma target 112 suited to aid in forming (or maintaining) a uniform layer of the plasma-forming material on the surface of the plasma target 112. For example, the system 100 may include, but is not limited to, a heating element arranged to smooth or control the density of the layer of plasma-forming material formed on the surface of the plasma target 112. By way of another example, the system 100 may include, but is not limited to, a blade device arranged to smooth and/or control the density of the plasma-forming material formed on the surface of the plasma target 112.

Figure 4A:
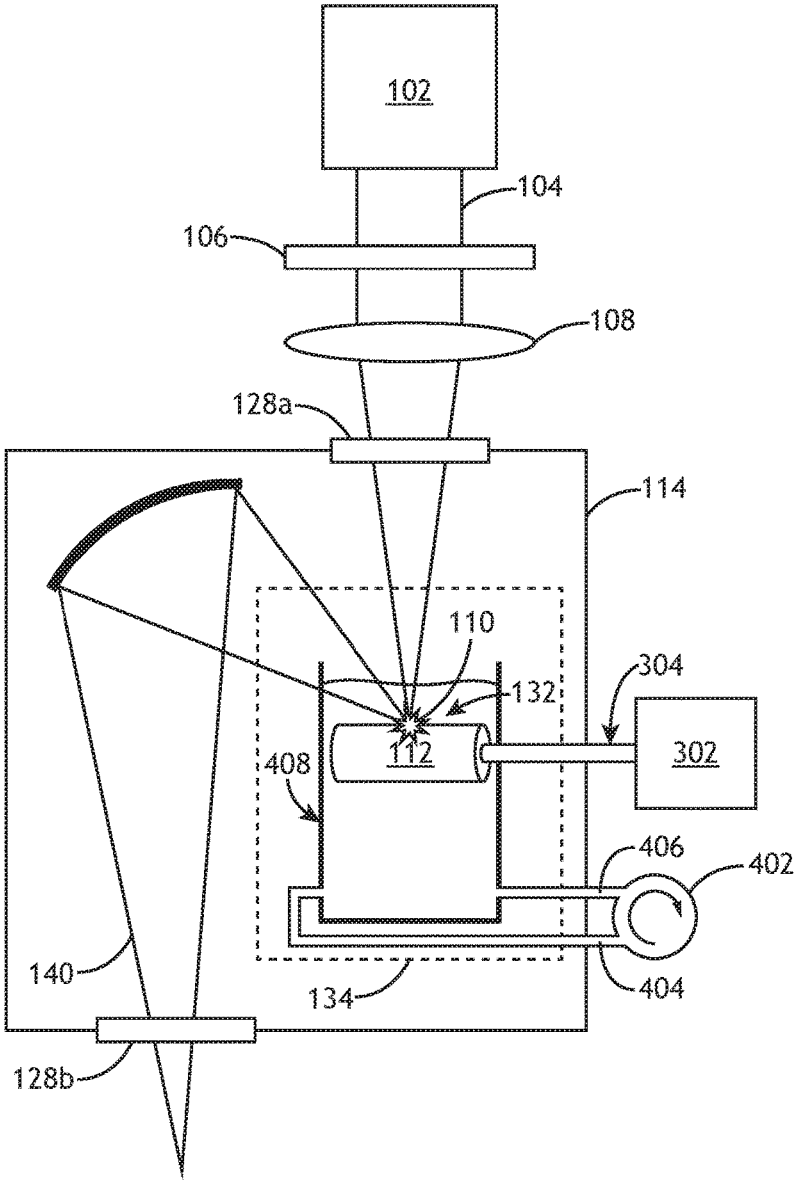
FIG. 4A is a high-level schematic view of a system for forming a continuous-wave laser-sustained plasma at the surface of a solid plasma target in the presence of a liquid buffer material, in accordance with one or more embodiments of the present disclosure.
Figure 4B:
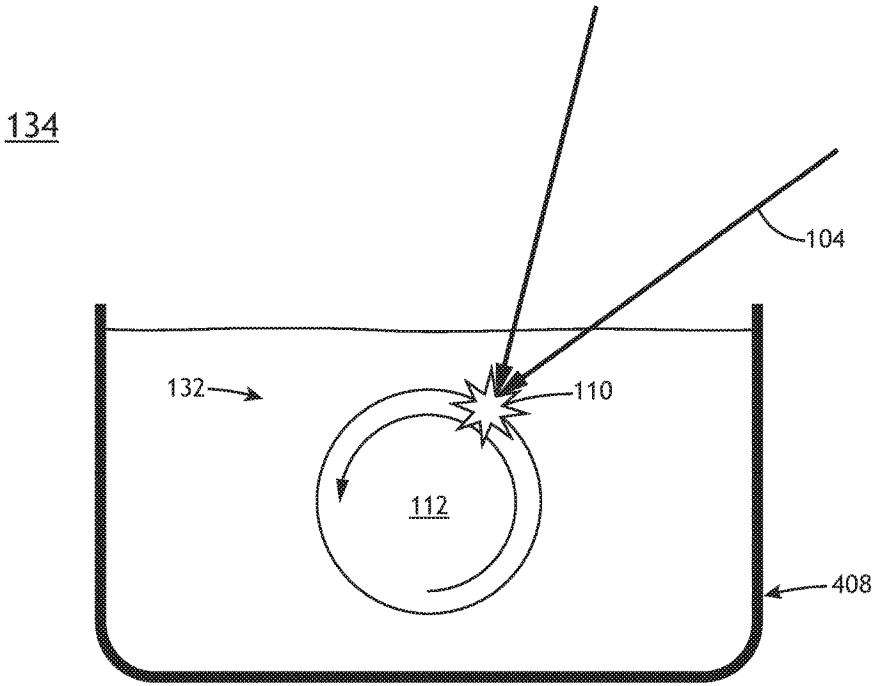
FIG. 4B is a high-level schematic view of a rotatable plasma target immersed in a liquid buffer, in accordance with one or more embodiments of the present disclosure.

FIG. 4A is a high-level schematic view of a system 100 for generating broadband radiation 140 emitted by a plasma generated with a solid-phase plasma target 112 in the presence of a liquid-phase buffer material 132, in accordance with one or more embodiments of the present disclosure. In one embodiment, the system 100 includes a rotatable plasma target 112 immersed in a liquid-phase buffer material. In another embodiment, the rotatable plasma target 112 is cylindrically symmetric about a rotation axis. FIG. 4B is a high-level schematic view of a target assembly 134 with a solid-phase rotatable plasma target 112, in accordance with one or more embodiments of the present disclosure. It is noted herein that a plasma 110 may be generated at the interface of a plasma target 112 and a buffer material 132 (e.g. as shown in FIG. 2A) or at a distance from a surface of the plasma target 112 (e.g. as shown in FIGS. 2B and 2C).

In one embodiment, the target assembly 134 includes a liquid-containment vessel 408 configured to contain the liquid-phase buffer material 132. In another embodiment, a liquid circulation assembly 402 circulates buffer material 132 through the liquid-containment vessel 408 (e.g. through an inlet 404 and an outlet 406). In another embodiment, the buffer material 132 operates to cool the plasma target 112. In a further embodiment, the liquid circulation assembly 402 includes a temperature-control assembly to maintain the plasma target 112 at a desired temperature using the buffer material 132 as a coolant.

In another embodiment, pump illumination 104 is focused into the volume of the liquid-phase buffer material 132 to generate or maintain a plasma 110. In one embodiment, the pump illumination 104 propagates into the liquid-containment vessel 408 through an opening in a side of the container (e.g. a top side as shown in FIG. 4A). In another embodiment, the pump illumination 104 propagates through a transmission element (not shown) on the liquid-containment vessel 408 which is transparent to the pump illumination 104.

Figure 5A:
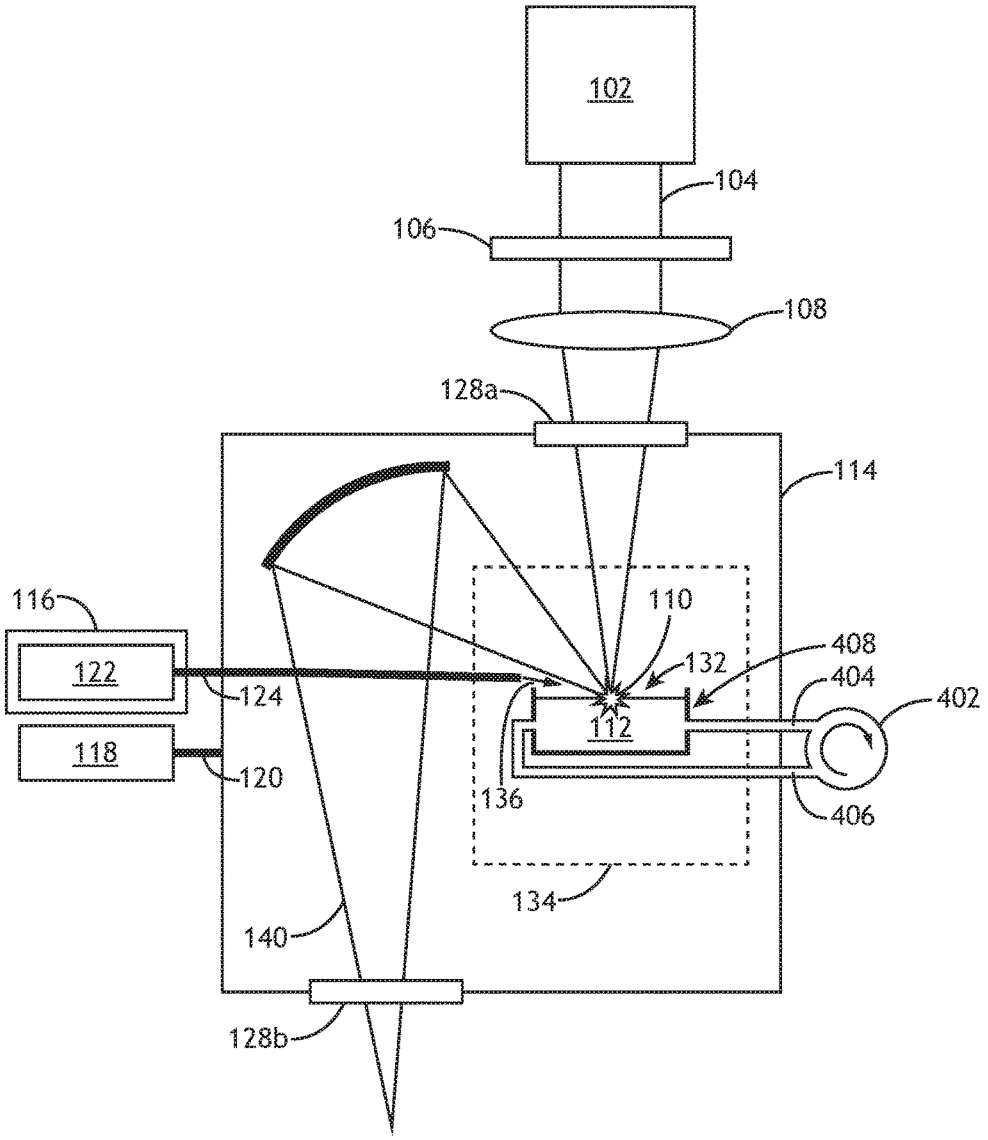
FIG. 5A is a high-level schematic view of a system for forming a continuous-wave laser-sustained plasma at the surface of a liquid plasma target in the presence of a gas buffer material, in accordance with one or more embodiments of the present disclosure.
Figure 5B:
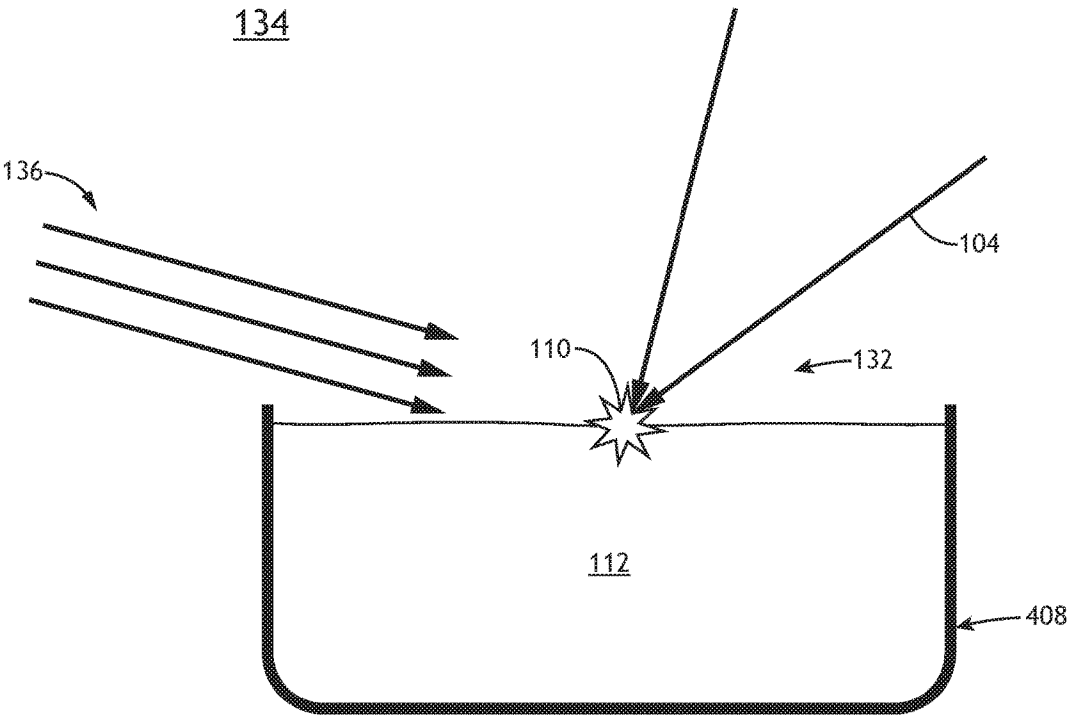
FIG. 5B is a high-level schematic view of a liquid plasma target, in accordance with one or more embodiments of the present disclosure.

FIG. 5A is a high-level schematic view of a system 100 for generating broadband radiation 140 emitted by a plasma generated with a liquid-phase plasma target 112 in the presence of a gas-phase buffer material 132, in accordance with one or more embodiments of the present disclosure. FIG. 5B is a simplified schematic view of a target assembly including a liquid-containment vessel 408 to contain the liquid-phase plasma target 112, in accordance with one or more embodiments of the present disclosure. It is noted herein that a plasma 110 may be generated at the interface of a plasma target 112 and a buffer material 132 (e.g. as shown in FIG. 2A).

In one embodiment, the system 100 includes a flow assembly 116 containing a nozzle 124 to direct a flow 136 of buffer material 132 towards the plasma. In another embodiment, the flow 136 of buffer material 132 directs plasma-forming material removed from the plasma target 112 away from the collector element 160.

In another embodiment, the target assembly 134 includes a liquid-containment vessel 408 configured to contain the liquid-phase plasma target 112. In another embodiment, a liquid circulation assembly 402 circulates plasma target 112 through the liquid-containment vessel 408 (e.g. through an inlet 404 and an outlet 406). In one embodiment, circulation of the plasma target 112 continually replenishes plasma-forming material from the plasma target 112 to the plasma 110. In another embodiment, circulation of the plasma target 112 provides cooling of the plasma target 112.

Figure 6A:
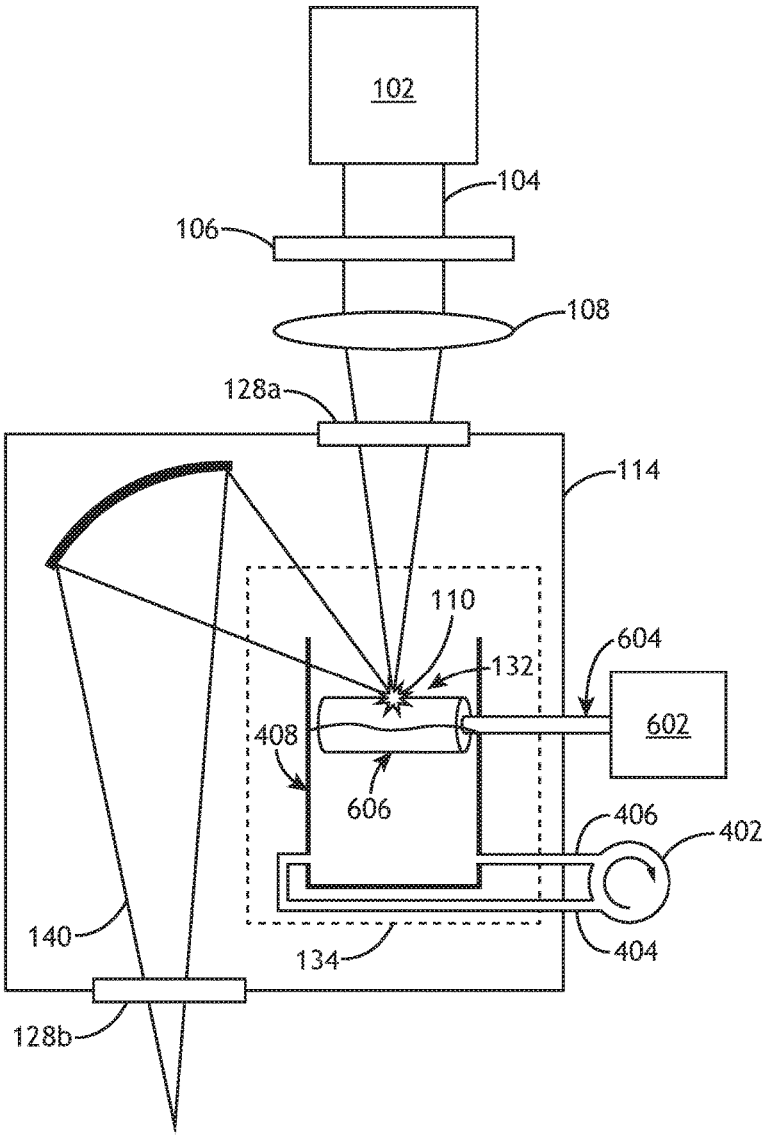
FIG. 6A is a high-level schematic view of a system for forming a continuous-wave laser-sustained plasma at the surface of a liquid plasma target circulated by a rotatable element in the presence of a gas buffer material, in accordance with one or more embodiments of the present disclosure.
Figure 6B:
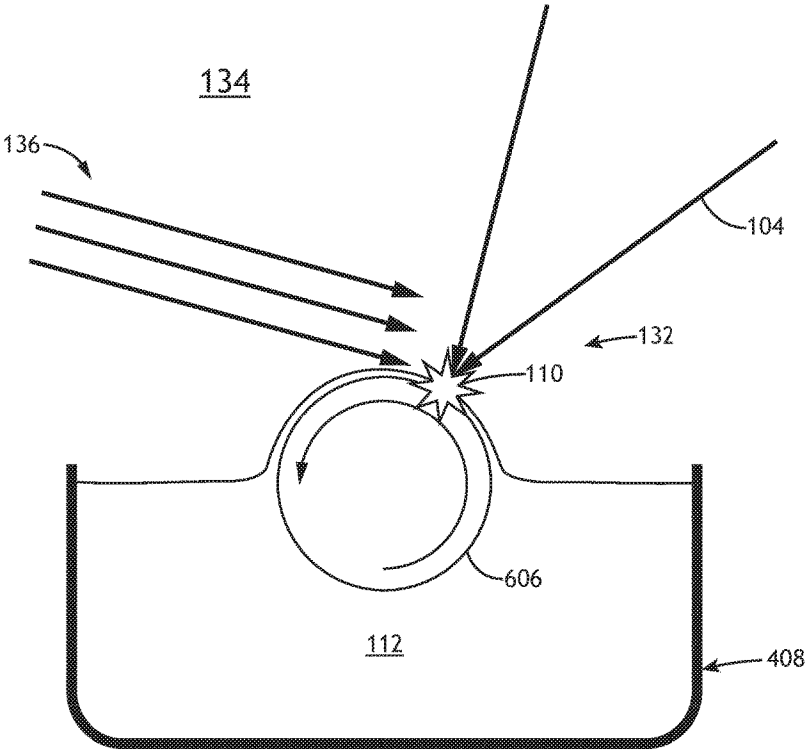
FIG. 6B is a high-level schematic view of a liquid plasma target circulated by a rotatable element, in accordance with one or more embodiments of the present disclosure.

FIG. 6A is a high-level schematic view of a system 100 for generating broadband radiation 140 emitted by a plasma 110 generated with a liquid-phase plasma target 112 circulated by a rotating element 606, in accordance with one or more embodiments of the present disclosure. FIG. 6B is a simplified schematic view of a target assembly including a liquid-containment vessel 408 to contain the liquid-phase plasma target 112 and a rotating element 606, in accordance with one or more embodiments of the present disclosure. In one embodiment, the rotating element 606 is cylindrically symmetric about a rotation axis. In one embodiment, the rotating element 606 is partially submerged in the liquid-phase plasma target 112. In another embodiment, the system includes a rotation assembly 602. In one embodiment, the rotation assembly 602 is configured to rotate the rotating element 606. In another embodiment, the rotation assembly 602 is configured to control the rotational state of the rotating element 606. For example, the rotation assembly 602 may include a rotational actuator (e.g., rotational stage) configured to rotate the plasma target 112 along the rotation axis such that the plasma 110 traverses a path corresponding to surface of the rotating element 606 at a selected axial position at a selected rotational speed.

In another embodiment, rotation of the rotating element 606 that is partially submerged in liquid-phase plasma target 112 generates a flowing liquid film of the plasma target 112 between the rotating element 606 and the gas-phase barrier material 132. In another embodiment, a plasma 110 is generated at the interface of the surface of the flowing plasma target 112 film and the buffer material 132. In this regard, the rotating element 606 provides a highly-controlled interface between the plasma target 112 and the buffer material 132 in which plasma-forming material is continually replenished by flow of the plasma target 112. In another embodiment, the rotating element 606 may be cooled by a temperature-control assembly such that the temperature of the plasma target 112 at the location of the plasma 110 is maintained at a desired value.

Figure 7A:
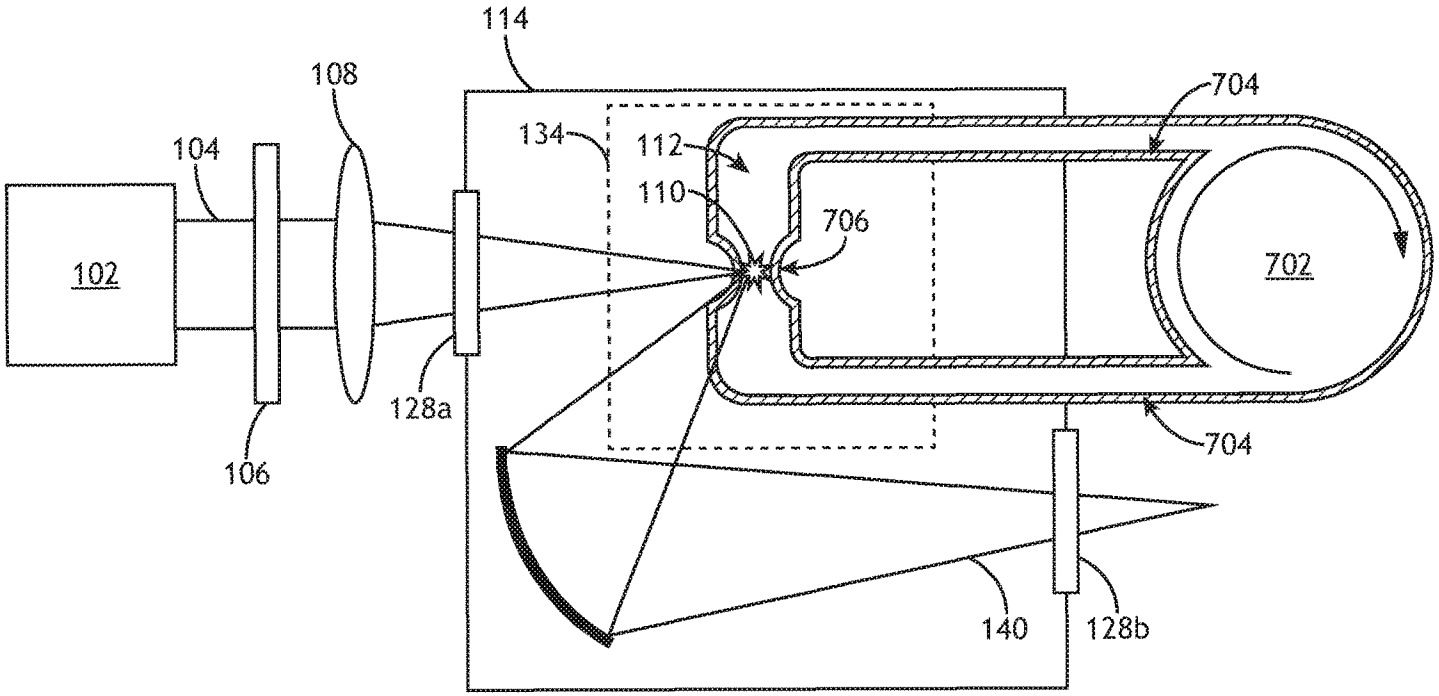
FIG. 7A is a high-level schematic view of a system for forming a continuous-wave laser-sustained plasma within the volume of a liquid plasma target, in accordance with one or more embodiments of the present disclosure.
Figure 7B:
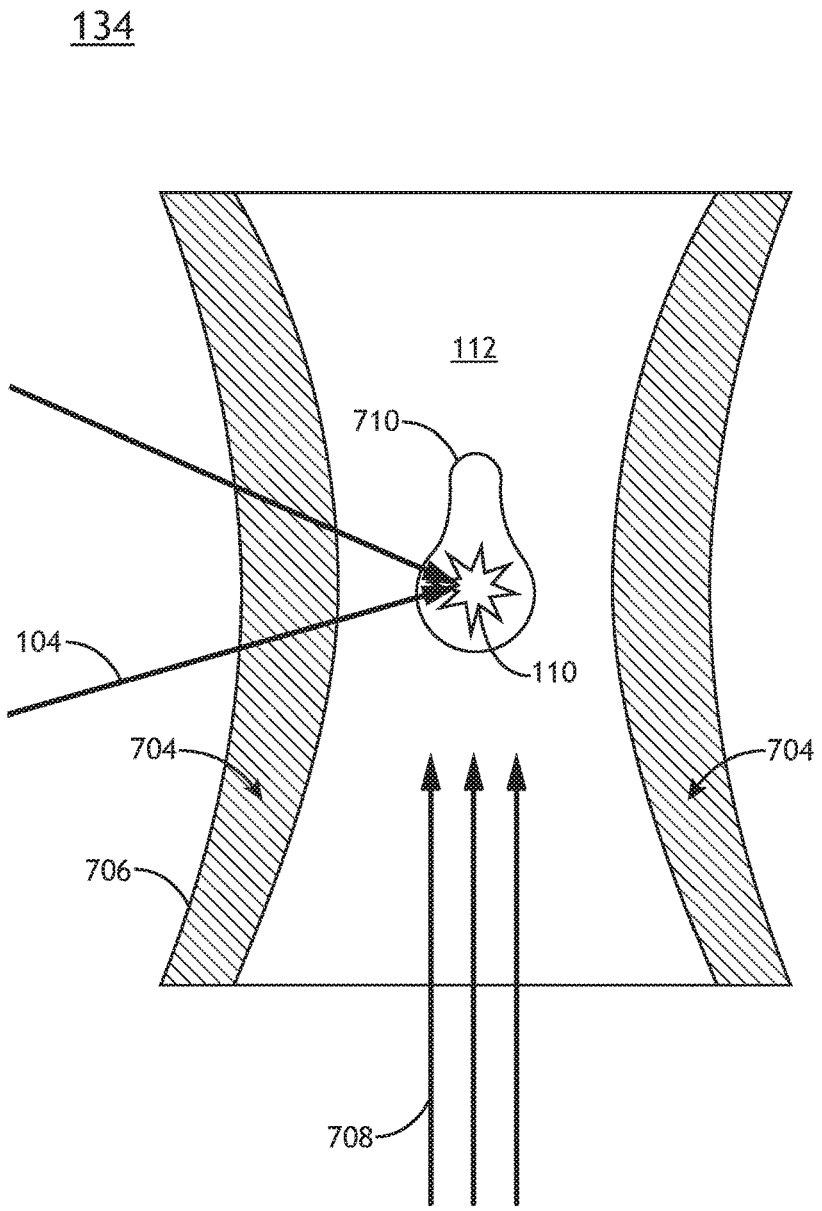
FIG. 7B is a conceptual view of a liquid-phase plasma target flowing through a nozzle, in accordance with one or more embodiments of the present disclosure.
Figure 7C:
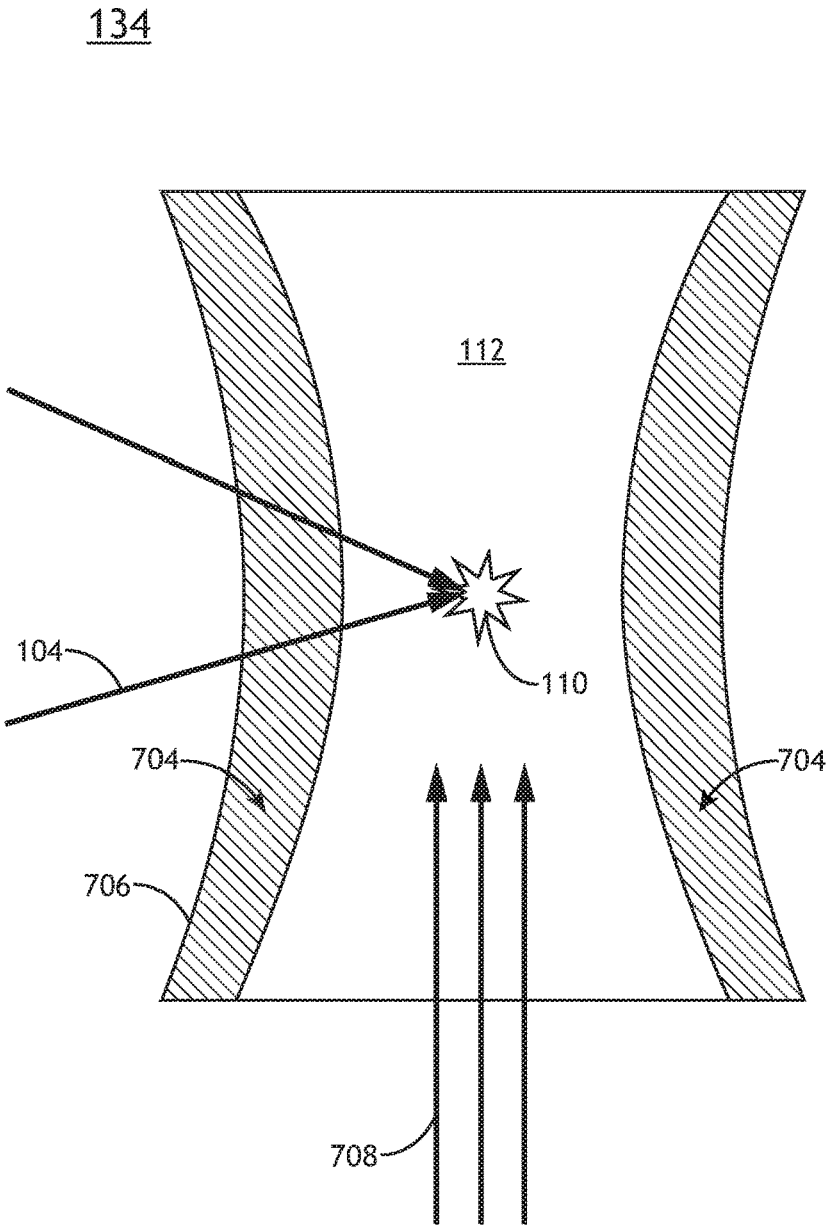
FIG. 7C is a conceptual view of a plasma target in a super-critical gas phase flowing through a nozzle, in accordance with one or more embodiments of the present disclosure.

In another embodiment, pump illumination 104 is focused (e.g. by a focusing element 108) to a location within the volume of a liquid-phase plasma target 112 to generate or maintain a plasma 110. FIGS. 7A through 7C are schematic views of a plasma 110 generated in a liquid-phase plasma target 112 circulated through a nozzle 706 by a circulation assembly 702, in accordance with one or more embodiments of the present disclosure. In one embodiment, a circulation assembly 702 directs a flow 708 of a plasma target 112 to the plasma 110. In another embodiment, the outer walls 704 of the nozzle 706 constrain the flow 708 of the plasma target 112 in the vicinity of the plasma 110. In another embodiment, the plasma target 112 is formed from a liquid jet. For example, a plasma target 112 formed from a liquid jet may be surrounded by gas (e.g. a free-flowing jet). As another example, a plasma target 112 formed from a liquid jet or may be surrounded by a nozzle.

Referring to FIG. 7B, in one embodiment, a plasma 110 ignited within the volume of a liquid-phase plasma target 112 generates a gas cavity 710 surrounding the plasma. In another embodiment, a length of a cross-section of the plasma 110 is larger than a length of a cross-section of the flow 708 of the plasma target 112. In another embodiment, the gas cavity 710 is formed from high-temperature gas advected from the plasma 110. In another embodiment, the system 100 includes a circulation assembly 702 to direct a flow 708 of plasma target 112 across the plasma 110. In one embodiment, the flow 708 of plasma target 112 replenishes plasma-forming material excited by the plasma 110 to provide continuous broadband radiation 140 from the plasma 110. In another embodiment, a flow 708 of the plasma target 112 provides a force to gas within the gas cavity 710 such that the gas cavity 710 is elongated in the direction of the flow 708. In another embodiment, hot gas advected from the plasma condenses to a liquid downstream of the plasma. In another embodiment, the plasma 110 and the gas cavity 710 reach a steady state. In another embodiment, the flow 708 of plasma target 112 through the nozzle 706 provides an undisturbed layer of liquid for the propagation of pump illumination 140 to the plasma 110. It is noted herein that a refractive index of gas in the gas cavity 710 may have a different value than a refractive index of liquid-phase plasma target 112. In this regard, pump illumination 104 is refracted at a phase boundary between the gas cavity 710 and the plasma target 112. In one embodiment, the system includes one or more optical elements (e.g. a focusing optic 108 or an optical element 106) to compensate for refraction at a phase boundary between the gas cavity 710 and the plasma target 112.

In another embodiment, the system 100 maintains the plasma target 112 at a temperature and pressure above a critical point such that the plasma target 112 is in a super-critical gas phase. Referring to FIG. 7C, in another embodiment, a plasma 110 is generated or maintained within the volume of a plasma target 112 in a super-critical gas phase. Accordingly, the plasma target 112 does not have distinct gas or liquid phases in the vicinity of the plasma 110. In this regard, a plasma 110 generated or maintained in the plasma target 112 by the pump illumination 104 may remain surrounded by the plasma target 112 in the super-critical gas phase (e.g. a gas cavity 710 as illustrated in FIG. 7B is not present) such that no phase boundary is present near the plasma 110. It is noted herein that a solubility of a material in a liquid phase may differ from a solubility of the material in a super-critical gas phase. In this regard, a plasma target 112 in a super-critical gas phase may include a concentration of plasma-forming material or a plasma-forming material element not possible for a plasma target 112 in a liquid phase.

It is noted herein that the description of the chamber 114 in FIGS. 1 through 7C and the associated descriptions are provided solely for illustrative purposes and should not be interpreted as limiting. In one embodiment, the system includes a target assembly 134 for containing a plasma target 112 and a buffer material 132. In this regard, the system may not include a chamber 114. For example, a system 100 may include a target assembly 134 containing a liquid-phase buffer material 132 and/or a liquid-phase plasma target 112 (e.g. without a chamber 114).

In another embodiment, the system 100 includes one or more propagation elements configured to direct broadband radiation 140 emitted from the chamber 114. For example the one or more propagation elements may include, but are not limited to, transmissive elements (e.g. a transmission element 128*a*,128*b*, one or more filters, and the like), reflective elements (e.g. the collector element 160, mirrors to direct the broadband radiation 140, and the like), or focusing elements (e.g. lenses, focusing mirrors, and the like).

In another embodiment, the collector element 160 collects broadband radiation 140 emitted by plasma 110 and directs the broadband radiation 140 to one or more downstream optical elements. For example, the one or more downstream optical elements may include, but are not limited to, a homogenizer, one or more focusing elements, a filter, a stirring mirror and the like. In another embodiment, the collector element 160 may collect broadband radiation 140 including extreme ultraviolet (EUV), deep ultraviolet (DUV), vacuum ultraviolet (VUV), ultraviolet (UV), visible and/or infrared (IR) radiation emitted by plasma 110 and direct the broadband radiation 140 to one or more downstream optical elements. In this regard, the system 100 may deliver EUV, DUV, VUV radiation, UV radiation, visible radiation, and/or IR radiation to downstream optical elements of any optical characterization system known in the art, such as, but not limited to, an inspection tool or a metrology tool. For example, the LSP system 100 may serve as an illumination sub-system, or illuminator, for a broadband inspection tool (e.g., wafer or reticle inspection tool), a metrology tool or a photolithography tool. It is noted herein the chamber 114 of system 100 may emit useful radiation in a variety of spectral ranges including, but not limited to, EUV, DUV radiation, VUV radiation, UV radiation, visible radiation, and infrared radiation.

The collector element 160 may take on any physical configuration known in the art suitable for directing broadband radiation 140 emanating from the plasma 110 to the one or more downstream elements. In one embodiment, as shown in FIG. 1, the collector element 160 may include a concave region with a reflective internal surface suitable for receiving broadband radiation 140 from the plasma and directing the broadband radiation 140 through transmission element 128*b*. For example, the collector element 160 may include an ellipsoid-shaped collector element 160 having a reflective internal surface. As another example, the collector element 160 may include a spherical-shaped collector element 160 having a reflective internal surface.

In one embodiment, system 100 may include various additional optical elements. In one embodiment, the set of additional optics may include collection optics configured to collect broadband light emanating from the plasma 110. In another embodiment, the set of optics may include one or more additional lenses (e.g., optical element 106) placed along either the illumination pathway or the collection pathway of system 100. The one or more lenses may be utilized to focus illumination from the CW illumination source 102 into the volume of chamber 114. Alternatively, the one or more additional lenses may be utilized to focus broadband radiation 140 emitted by the plasma 110 onto a selected target (not shown).

In another embodiment, the set of optics may include one or more filters. In another embodiment, one or more filters are placed prior to the chamber 114 to filter pump illumination 140. In another embodiment, one or more filters are placed after the chamber 114 to filter radiation emitted from the chamber 114.

In another embodiment, the CW illumination source 102 is adjustable. For example, the spectral profile of the output of the CW illumination source 102 may be adjustable. In this regard, the CW illumination source 102 may be adjusted in order to emit a pump illumination 104 of a selected wavelength or wavelength range. It is noted that any adjustable CW illumination source 102 known in the art is suitable for implementation in the system 100. For example, the adjustable CW illumination source 102 may include, but is not limited to, one or more adjustable wavelength lasers.

In another embodiment, the CW illumination source 102 of system 100 may include one or more lasers. In a general sense, the CW illumination source 102 may include any CW laser system known in the art. For instance, the CW illumination source 102 may include any laser system known in the art capable of emitting radiation in the infrared, visible or ultraviolet portions of the electromagnetic spectrum.

In another embodiment, the CW illumination source 102 may include one or more diode lasers. For example, the CW illumination source 102 may include one or more diode lasers emitting radiation at a wavelength corresponding with any one or more absorption lines of the plasma target 112. In a general sense, a diode laser of the CW illumination source 102 may be selected for implementation such that the wavelength of the diode laser is tuned to any absorption line of any plasma 110 (e.g., ionic transition line) or any absorption line of the plasma-forming material (e.g., highly excited neutral transition line) known in the art. As such, the choice of a given diode laser (or set of diode lasers) will depend on the type of plasma target 112 within the chamber 114 of system 100.

In another embodiment, the CW illumination source 102 may include an ion laser. For example, the CW illumination source 102 may include any noble gas ion laser known in the art. For instance, in the case of an argon-based plasma target 112, the illumination source 102 used to pump argon ions may include an Ar+ laser.

In another embodiment, the CW illumination source 102 may include one or more frequency converted laser systems. For example, the CW illumination source 102 may include a Nd:YAG or Nd:YLF laser having a power level exceeding 100 Watts. In another embodiment, the CW illumination source 102 may include a broadband laser. In another embodiment, the CW illumination source may include a laser system configured to emit modulated CW laser radiation.

In another embodiment, the CW illumination source 102 may include one or more lasers configured to provide laser light at substantially a constant power to the plasma 110. In another embodiment, the CW illumination source 102 may include one or more modulated lasers configured to provide modulated laser light to the plasma 110. It is noted herein that the above description of a CW laser is not limiting and any CW laser known in the art may be implemented in the context of the present disclosure.

In another embodiment, the CW illumination source 102 may include one or more non-laser sources. In a general sense, the illumination source 102 may include any non-laser light source known in the art. For instance, the CW illumination source 102 may include any non-laser system known in the art capable of emitting radiation discretely or continuously in the infrared, visible or ultraviolet portions of the electromagnetic spectrum.

It is noted herein that the set of optics of system 100 as described above and illustrated in FIGS. 1A through 7C are provided merely for illustration and should not be interpreted as limiting. It is anticipated that a number of equivalent optical configurations may be utilized within the scope of the present disclosure.

The herein described subject matter sometimes illustrates different components contained within, or connected with, other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "connected", or "coupled", to each other to achieve the desired functionality, and any two components capable of being so associated can also be viewed as being "couplable", to each other to achieve the desired functionality. Specific examples of couplable include but are not limited to physically mateable and/or physically interacting components and/or wirelessly interactable and/or wirelessly interacting components and/or logically interacting and/or logically interactable components.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes. Furthermore, it is to be understood that the disclosure is defined by the appended claims.

What is claimed is:

1. An optical system for generating broadband light via light-sustained plasma formation, comprising:

a chamber, the chamber configured to contain a buffer material in a first phase and a plasma-forming material in a second phase, wherein the second phase is at least one of a solid phase or a liquid phase;

an illumination source configured to generate continuous-wave pump illumination;

a set of focusing optics configured to focus the continuous-wave pump illumination through the buffer material to an interface between the buffer material and the plasma-forming material in order to generate a plasma by excitation of at least the plasma-forming material;

a set of collection optics configured to receive broadband radiation emanated from the plasma; and a flow subsystem configured to direct a flow of the buffer material to the plasma, the flow subsystem including a nozzle directed at the plasma so that the flow of the buffer material intersects with an illumination path of the continuous-wave pump illumination at the interface between the buffer material and the plasma-forming material.

2. The optical system of claim 1, wherein a phase of the buffer material comprises:

at least one of a gas phase or a liquid phase.

3. The optical system of claim 1, wherein a phase of the plasma-forming material comprises:

a solid phase.

4. The optical system of claim 3, wherein the plasma-forming material comprises:

a cylindrically-symmetric element.

5. The optical system of claim 3, wherein the cylindrically-symmetric element comprises:

at least one of a cylinder, a drum, or a disk.

6. The optical system of claim 3, wherein the plasma-forming material comprises:

a wire.

7. The optical system of claim 1, wherein the phase of the plasma-forming material comprises:

a liquid phase.

8. The optical system of claim 7, wherein the plasma-forming material comprises:

an aqueous solution of a plasma-forming element.

9. The optical system of claim 8, wherein the plasma-forming element is in a salt form.

10. The optical system of claim 7, wherein the plasma-forming material includes a solvent.

11. The optical system of claim 7, further comprising:

a liquid flow assembly configured to direct a flow of the plasma-forming material to the plasma.

12. The optical system of claim 11, wherein the liquid flow assembly includes a rotating element at least partially immersed in the plasma-forming material.

13. The optical system of claim 12, wherein a rotation of the rotating element forms a flowing layer of the plasma-forming material adjacent to the surface of the rotating element.

14. The optical system of claim 11, wherein the liquid flow subsystem includes a nozzle.

15. The optical system of claim 7, wherein the flow of the plasma-forming material is a liquid jet.

16. The optical system of claim 1, wherein the plasma-forming material comprises:

at least one of nickel, copper, or beryllium.

17. The optical system of claim 1, wherein the buffer material comprises:

at least one of argon, nitrogen, or xenon.

18. The optical system of claim 1, further comprising:

a cooling assembly, wherein the cooling assembly controls a temperature of the plasma-forming material.

19. The optical system of claim 18, wherein the cooling assembly controls the temperature of the plasma-forming material through liquid cooling.

20. The optical system of claim 18, wherein the cooling assembly controls the temperature of the plasma-forming material through air cooling.

21. The optical system of claim 1, wherein a portion of the plasma-forming material is removed by the generation of the plasma.

22. The optical system of claim 21, wherein the plasma-forming material is translated such that the portion of the plasma-forming material removed by the generation of the plasma is replenished.

23. The optical system of claim 1, wherein the broadband radiation collected by the set of collection optics is directed to a sample.

24. The optical system of claim 1, wherein the broadband radiation collected by the set of collection optics is utilized by at least one of an inspection tool, a metrology tool, or a semiconductor device fabrication line tool.

25. An optical system for generating broadband light via light-sustained plasma formation, comprising:

a chamber, the chamber configured to contain a buffer gas;

an illumination source configured to generate continuous-wave pump illumination;

a plasma-forming material disposed within the chamber, wherein a phase of the plasma-forming material includes at least one of a solid phase or a liquid phase, wherein at least a portion of the plasma-forming material is removed from a portion of a surface of the plasma-forming material proximate to the plasma;

a set of focusing optics configured to focus the continuous-wave pump illumination onto the at least a portion of the plasma-forming material removed from the portion of the surface of the plasma-forming material to generate a plasma;

a set of collection optics configured to receive broadband radiation emanated from the plasma; and a gas flow subsystem configured to direct a flow of the buffer gas to the plasma, the gas flow subsystem including a nozzle directed at the plasma so that the flow of the buffer gas intersects with an illumination path of the continuous-wave pump illumination at the plasma.

26. The optical system of claim 25, wherein the gas flow subsystem directs the plasma-forming material removed from the portion of the surface of the plasma-forming material proximate to the plasma away from at least one of the set of focusing optics or the set of collection optics.

27. The optical system of claim 25, wherein removal of the plasma-forming material provides a vapor pressure of the plasma-forming material of 10 atm.

28. The optical system of claim 25, wherein the phase of the plasma-forming element comprises:

a solid phase.

29. The optical system of claim 28, wherein at least a portion of the plasma-forming material is removed from the portion of the surface of the plasma-forming material proximate to the plasma by sublimation.

30. The optical system of claim 28, wherein the portion of the surface of the plasma-forming material proximate to the plasma comprises:

a liquid phase, wherein the at least a portion of the plasma-forming material removed from the portion of the surface of the plasma-forming material proximate to the plasma is removed by evaporation.

31. The optical system of claim 28, wherein the plasma-forming material comprises:

a cylindrically-symmetric element.

32. The optical system of claim 31, wherein the cylindrically-sym metric element comprises:

at least one of a cylinder, a drum, or a disk.

33. The optical system of claim 28, wherein the plasma-forming material comprises:

a wire.

34. The optical system of claim 25, wherein the plasma-forming material is translated such that the at least a portion of the plasma-forming material removed from the portion of the surface of the plasma-forming material proximate to the plasma is replenished.

35. The optical system of claim 25, wherein the plasma-forming material comprises:

at least one of nickel, copper, or beryllium.

36. The optical system of claim 25, wherein the buffer gas comprises:

at least one of argon, nitrogen, or xenon.

37. The optical system of claim 25, further comprising:

a cooling assembly, wherein the cooling assembly controls a temperature of the plasma-forming material.

38. The optical system of claim 37, wherein the cooling assembly controls the temperature of the plasma-forming material through liquid cooling.

39. The optical system of claim 25, wherein the phase of the plasma-forming element comprises:

a liquid phase.

40. The optical system of claim 39, further comprising:

a liquid flow assembly configured to direct a flow of the plasma-forming material to the plasma.

41. The optical system of claim 25, wherein the at least a portion of the plasma-forming material removed from the portion of the surface proximate to the plasma is removed at least in part in response to heat associated with the plasma.

42. The optical system of claim 25, wherein the at least a portion of the plasma-forming material removed from the portion of the surface proximate to the plasma is removed at least in part in response to absorption of the continuous-wave pump illumination.

43. The optical system of claim 25, wherein the at least a portion of the plasma-forming material removed from the portion of the surface proximate to the plasma is removed at least in part in response to absorption of energy associated with at least one of an electron beam, an electrical arc, or illumination generated by a second illumination source.

44. The optical system of claim 25, wherein the broad-band radiation collected by the set of collection optics is directed to a sample.

45. The optical system of claim 25, wherein the broad-band radiation collected by the set of collection optics is utilized by at least one of an inspection tool, a metrology tool, or a semiconductor device fabrication line tool.

* * * * *